US008190061B2

(12) United States Patent
Kawahata et al.

(10) Patent No.: US 8,190,061 B2
(45) Date of Patent: May 29, 2012

(54) IMAGE FORMING APPARATUS

(75) Inventors: Yasushi Kawahata, Kanagawa (JP); Yutaka Nogami, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 220 days.

(21) Appl. No.: 12/728,621

(22) Filed: Mar. 22, 2010

(65) Prior Publication Data

US 2011/0064468 A1 Mar. 17, 2011

(30) Foreign Application Priority Data

Sep. 14, 2009 (JP) ..... 2009-212505

(51) Int. Cl.
*G03G 15/16* (2006.01)

(52) U.S. Cl. ..... 399/122; 399/69; 399/384

(58) Field of Classification Search ..... 399/69, 399/122, 328, 384
See application file for complete search history.

(56) References Cited

U.S. PATENT DOCUMENTS 6,047,156 A * 4/2000 De Bock et al. ..... 399/298
6,430,381 B1 * 8/2002 Kopp ..... 399/69

FOREIGN PATENT DOCUMENTS

JP 7-319303 A 12/1995
JP 10-123864 A 5/1998
JP 2000-089585 A 3/2000
JP 2003-167459 A 6/2003
JP 2006-267769 A 10/2006

* cited by examiner

*Primary Examiner* — Hoang Ngo
(74) *Attorney, Agent, or Firm* — Sughrue Mion, PLLC

(57) ABSTRACT

An image forming apparatus includes: a transporting path; a heating unit on the transporting path that is movably provided in a direction coming in contact with and departing from a continuous recording medium and that heats the continuous recording medium; a braking unit that has a first braking member and a second braking member and that brakes transportation of the continuous recording medium by sandwiching in the continuous recording medium between the first and second braking members, wherein the first and second braking members are provided on upstream and downstream sides on the transporting path of the heating unit, respectively; and a control unit that controls that the heating unit is brought into contact with the continuous recording medium and the braking of the continuous recording medium is released by the braking unit.

5 Claims, 9 Drawing Sheets

IMAGE FORMING APPARATUS

CROSS-REFERENCE TO RELATED APPLICATION

This application is based on and claims priority under 35 USC 119 from Japanese Patent Application No. 2009-212505 filed on Sep. 14, 2009.

BACKGROUND

1. Technical Field

This invention relates to an image forming apparatus.

2. Related Art

In an image forming apparatus which forms an image on a continuous recording medium such as a rolls of paper (continuous sheet) by means of an electrophotography technique, in order to carry out image formation at a high speed, the continuous recording medium with the image formed by toners is subjected to heating using a heating means before the image is fixed by a fixing means.

SUMMARY

According to an aspect of the invention, an image forming apparatus comprising: a transporting path along which a continuous recording medium formed an image is transported; a heating unit on the transporting path that is movably provided in a direction coming in contact with and departing from the continuous recording medium and that heats the continuous recording medium; a braking unit that has a first braking member and a second braking member and that brakes transportation of the continuous recording medium by sandwiching in the continuous recording medium between the first braking member and the second braking member, wherein the first braking member is provided on upstream side on the transporting path of the heating unit and the second braking member is provided on downstream side on the transporting path of the heating unit; and a control unit that controls that the heating unit is brought into contact with the continuous recording medium and the braking of the continuous recording medium is released by the braking unit, and that the heating unit is moved in the direction departing from the continuous recording medium and the continuous recording medium is braked by the braking unit.

BRIEF DESCRIPTION OF THE DRAWINGS

Exemplary embodiments of the invention will be described in detail based on the following figures, wherein.

DETAILED DESCRIPTION

Figure 1:
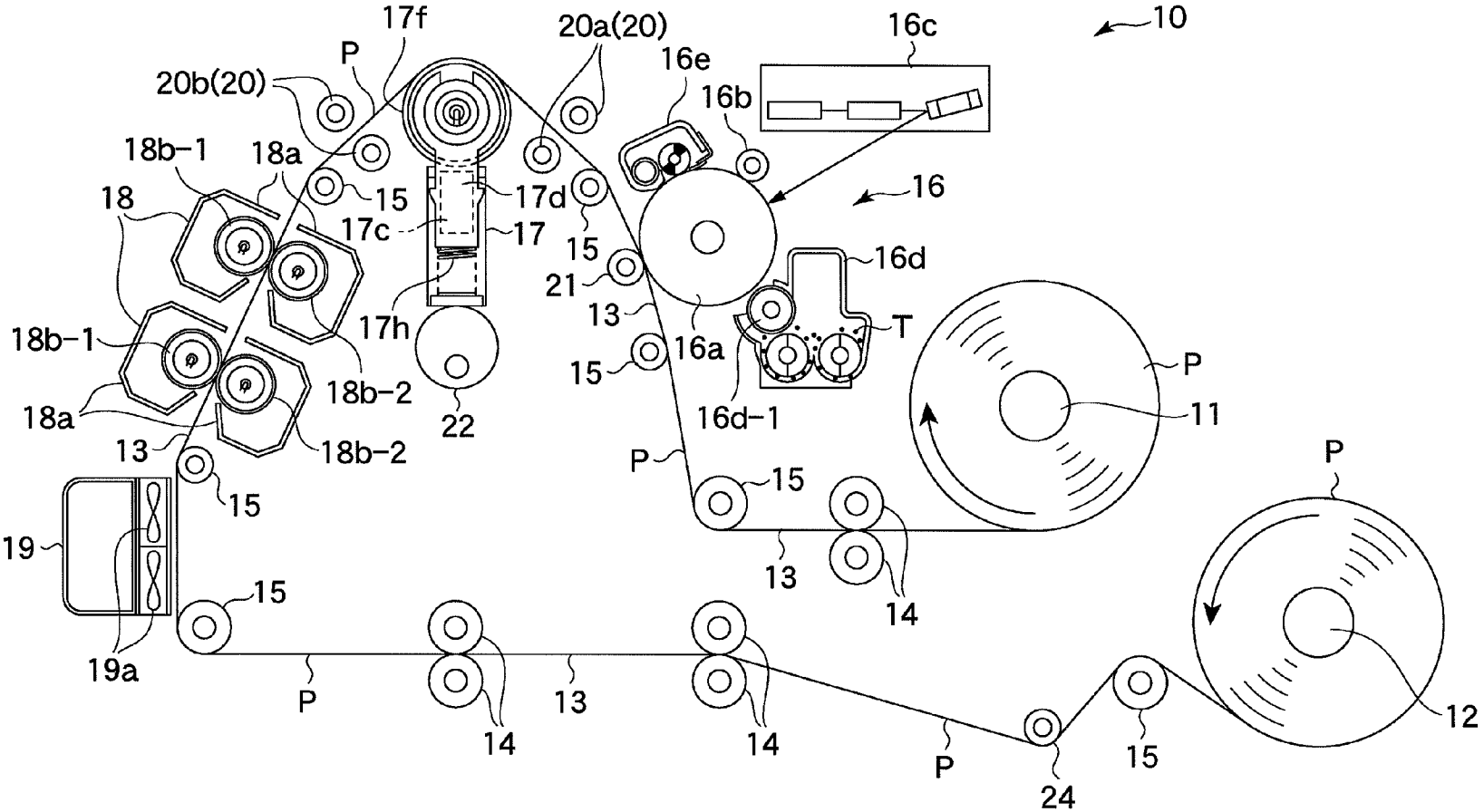
FIG. 1 is a conceptual view showing an image forming apparatus according to an exemplary embodiment of this invention.

Hereinbelow, referring to the drawings, a detailed explanation will be given of an exemplary embodiment of this invention. It should be noted that in the drawings for explaining the exemplary embodiment, like reference symbols refer to like constituent components to avoid repetitive explanation.

As show in FIG. 1, an image forming apparatus 10 according to an exemplary embodiment of this invention includes a feed-out mandrel 11 to which a continuous sheet P such as a rolls of paper (an example of a continuous recording medium) on which image formation is done; and a take-up mandrel 12 on which the continuous sheet P having completed the image formation is wound. Between these mandrels 11 and 12, a transporting path 13 is formed along which the continuous sheet P is transported. At plural positions on the transporting path 13, arranged are continuous sheet transporting rollers 14 for transporting the continuous sheet P and tension rollers 15 for transporting the continuous sheet P along the transporting path 13 while giving tension. In the vicinity of the take-up mandrel 12 of the transporting path 13, a loop quantity determining roller 24 is arranged for determining the loop quantity of the continuous sheet P to control the rotating speed of the take-up mandrel 12. It should be noted that in the drawing, since the continuous sheet P and the transporting path 13 overlap with each other, symbols P and 13 are alternately given.

On the transporting path 13 from the feed-out mandrel 11 to the take-up mandrel 12, an image forming unit 16 (image forming means) is arranged which executes the image formation using toners (an example of a developer) on the continuous sheet P. On the downstream side on the transporting path of the image forming unit 16, successively arranged along the transporting direction are a pre-heating member 17 (an example of a heating means) which previously heats the continuous sheet P with the image formation by the image forming unit 16 prior to fixing; two fixing devices 18 (an example of a fixing means) which fix the toner image as an image on the continuous sheet P pre-heated; and a cooler 19 which cools the continuous sheet P with the toner image fixed using a fan 19*a*.

Further, on both sides in the transporting direction of the pre-heating member 17, a pair of braking members 20 (an upstream braking member 20*a* and a downstream braking member 20*b*) are arranged, respectively which sandwich the continuous sheet P from both faces while the image formation is not executed, thereby braking its transportation.

Additionally, in this exemplary embodiment, the braking member 20 (an example of the braking means) is constructed of a pair of rollers, but may be realized by various structures for sandwiching the continuous sheet P to stop the transportation such as a combination of a roller and a pad or a combination of a pair of pads.

Additionally, in the image forming apparatus according to this exemplary embodiment, two units of the fixing devices 18 are arranged to assure toner fixing capability even where the image formation is done at an ultra high speed of a process speed of e.g. 1000 mm/s or higher.

Now, the reason of adopting the structure of previously heating the continuous sheet P by the pre-heating member 17 prior to fixing by the fixing devices 18 is as follows.

Specifically, in the image forming apparatus 10 in a heat-fixing system using the continuous sheet P, where the image formation is executed at a high speed, if the transporting speed of the continuous sheet P increases, the heating time in the fixing devices 18 becomes incapable of being ensured. This gives rises to the phenomenon called "cold offset" that the toners are deposited on the rollers of the fixing devices 18. In order to obviate such inconvenience, as described below, the pre-heating member 17 is brought into contact with the face opposite to the image forming face of the continuous sheet P to previously boost the temperature at the boundary between the continuous sheet P and toners, thereby making up for shortage of the heating time at a high speed.

Now, the image forming unit 16 includes a photoconductor drum 16*a* which is an image carrier rotating at a predetermined speed; a charging roller 16*b* which charges the surface of the photoconductor drum 16*a* at a predetermined potential; an exposure device 16*c* which exposes the image to the surface of the photoconductor drum 16*a* to form an electrostatic latent image; a developing device 16*d* which develops the electrostatic image formed on the photoconductor drum 16*a* using toners; and a cleaning device 16*e* which removes transfer residual toners remaining on the photoconductor drum 16*a* after development.

The developing device 16*d*, as shown in FIG. 1, supplies toners T accommodated to a developing roller 16*d*-1 while stirring them, transports them to a developing region opposite to the photoconductor drum 16*a* while controlling the layer thickness of the toners supplied to the developing roller 16*d*-1 and develops the electrostatic latent image formed on the photoconductor drum 16*a* using the tones.

On the side opposite to the photoconductor drum 16*a* across the continuous sheet P, a transfer roller 21 is provided which transfers the toner image thus formed on the photoconductor drum 16*a* onto the continuous sheet P.

Incidentally, in this exemplary embodiment, the developer containing the toners, i.e. one component is employed, but a two-component developer composed of carries and toners may be employed. In this exemplary embodiment, a single image forming unit 16 is provided to execute the image formation with a single color e.g. black.

Figure 2:
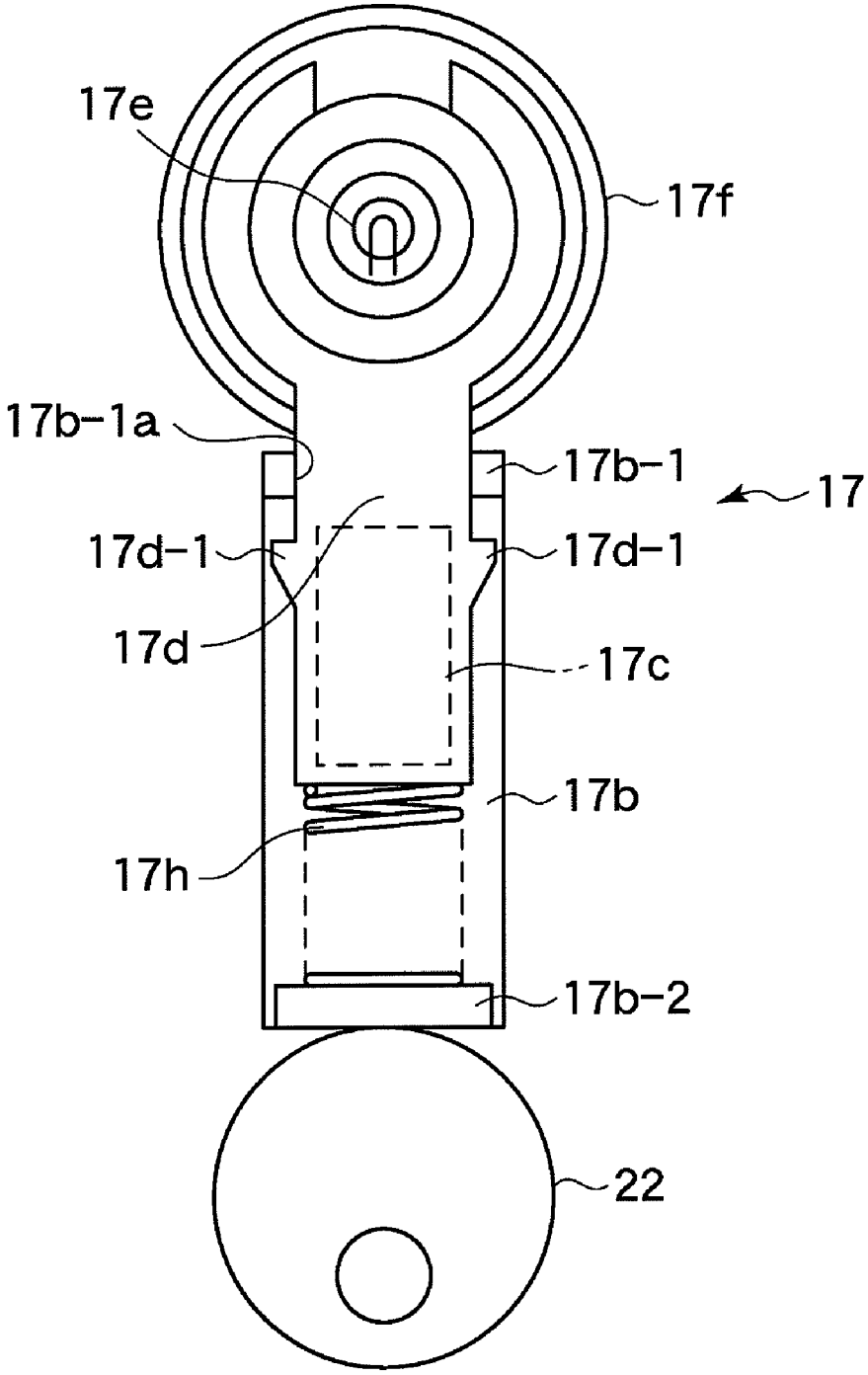
FIG. 2 is a front view showing a pre-heating member and an eccentric cam which are provided in the image forming apparatus.
Figure 3:
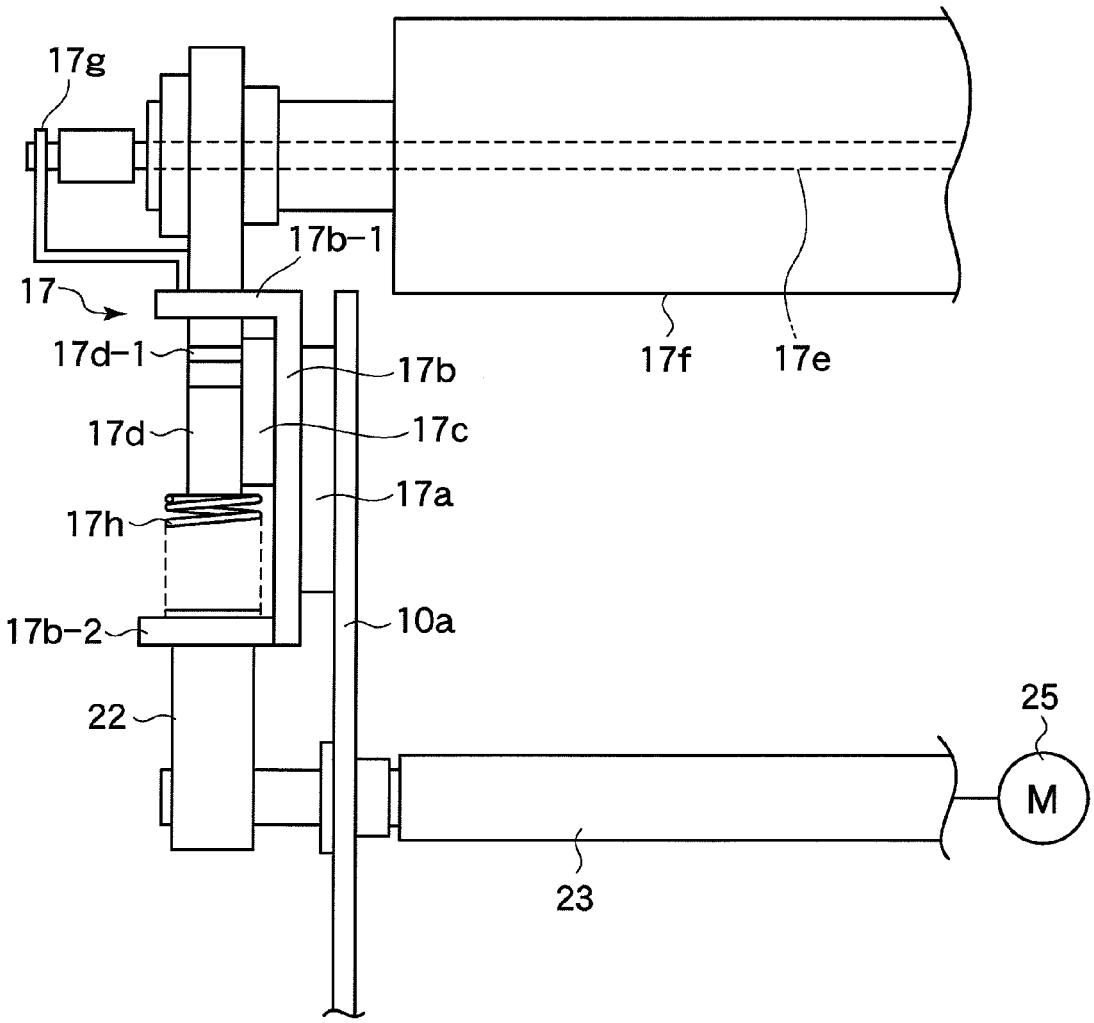
FIG. 3 is a side view of FIG. 2.

The pre-heating member 17, as shown in FIGS. 2 and 3, has a holder support 17*b* (an example of an accommodator) which reciprocates in a linear direction (in this exemplary embodiment, in a vertical direction) through a first linear slider 17*a* attached to a frame 10*a* on the apparatus body side. The pre-heating member 17, therefore, is provided movably, i.e. ascendably/descendably in the vertical direction.

It should be noted that the transporting speed is set so that the contact time between the continuous sheet P and the pre-heating member 17 is 0.3 sec or longer at the same position of the continuous sheet P.

At the upper end and lower end of the holder support 17*b*, formed are an upper plate 17*b*-1 and lower plate 17*b*-2 which extend forward. At the center in the width direction of the upper plate 17*b*-1, a recess 17*b*-1*a* a vertically opened is formed; a roller holder 17*d* which reciprocates in the linear direction (in this exemplary embodiment, in the vertical direction) through a second linear slider 17*c* attached to the holder support 17*b* is held in the holder support 17*b* so that it passes through the recess 17*b*-1*a*. In the upper portion of the roller holder 17*d*, a heater 17*e* is internally provided, and a heating roller 17*f* which comes in contact with the continuous sheet P from below to heat it is attached. Incidentally, the heater 17*e* is held in a heater holder 17*g* attached to the roller holder 17*d*.

Now, as regards the pre-heating member 17 according to this exemplary embodiment, its heating roller 17*f* which is a spot of heating the continuous sheet P is located at the uppermost portion of the image forming apparatus 10. This intends to effectively exhaust the heat generated from the pre-heating member 17 (more correctly, the heating roller 17*f* of the pre-heating member 17). Thus, the members constituting the image forming apparatus 10 will be prevented from thermally deteriorated.

Incidentally, as shown in FIG. 1, the contact face of the heating roller 17*f* with the continuous sheet P is a face opposite to the face of forming the toner image on the continuous sheet P by the image forming unit 16, i.e. a non-forming face of the toner image.

Between the bottom of the roller holder 17*d* with the heating roller 17*f* attached and the lower plate 17*b*-2 of the holder support 17*b*, a coil spring 17*h* (an example of a tension giving portion) is fit. Further, on both sides of the roller holder 17*d*, a pair of projections 17*d*-1 outwardly projecting are formed at the same height as each other. The projection 17*d*-1 is located below the upper plate 17*b*-1 of the holder support 17*b* so that when the roller holder 17*d* ascends along the second linear slider 17*c* owing to the spring force of the coil spring 17*h*, it hits against the upper plate 17*b*-1 of the holder support 17*b*.

Beneath the pre-heating member 17 having the structure described above, an eccentric cam 22 (an example of a moving means) is arranged. The eccentric cam 22 is formed in a circular shape. The eccentric cam 22 is attached eccentrically to a cam shaft 23 which is supported by a frame 10*a* and rotated by an eccentric cam driving motor 25 (an example of a moving means) such as a stepping motor.

Figure 4:
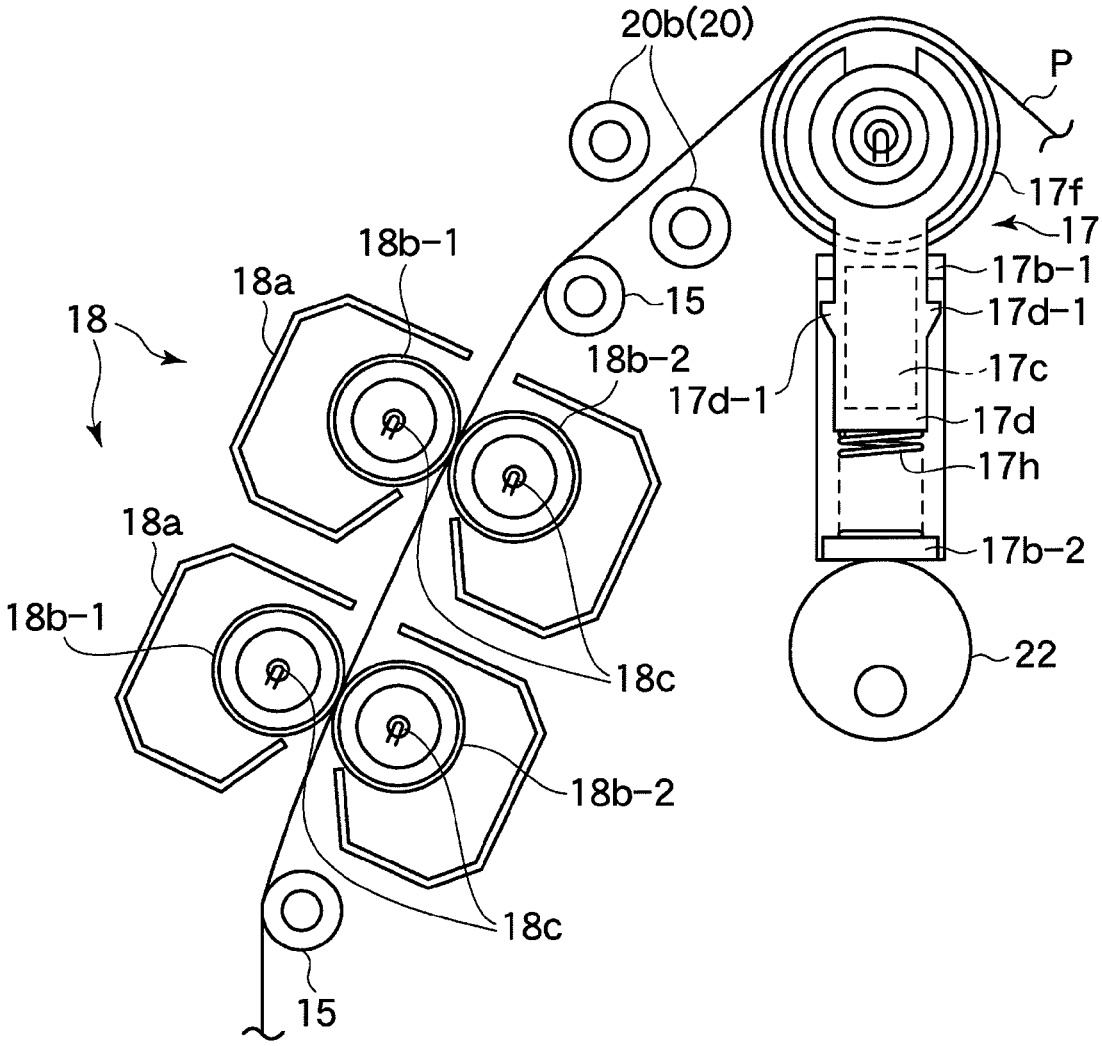
FIG. 4 is a view for explaining positions of the pre-heating member and a fixing device when an image forming operation is executed in the image forming apparatus shown in FIG. 1.

Owing to the driving force of the eccentric cam driving motor 25 driving the eccentric cam 22, the eccentric cam 22 is rotated while its outer surface comes in contact with the bottom of the holder support 17*b* of the pre-heating member 17. Thus, as shown in FIG. 4, the eccentric cam 22 moves to a first position to elevate the pre-heating member 17 provided so as to freely ascend/descend thereby to come in contact to the continuous sheet P and stops there.

At this time, the coil spring 17*h* is compressed according to the stress when the heating roller 17*f* comes in contact with the continuous sheet P and also expands/contracts so that the heating roller 17*f* follows the floating/sinking of the continuous sheet P during transportation. Thus, a required tension is always imparted to the continuous sheet P. As a result, the slack of the continuous sheet P during transportation disappears owing to the tension imparted by the coil spring 17*h* so that the pre-heating member 17 surely comes in contact with the continuous sheet P to heat it.

It should be noted that the tension imparting unit is not limited to the coil spring 17*h* but may be various members having the same function as the coil spring 17*h* described above.

Figure 5:
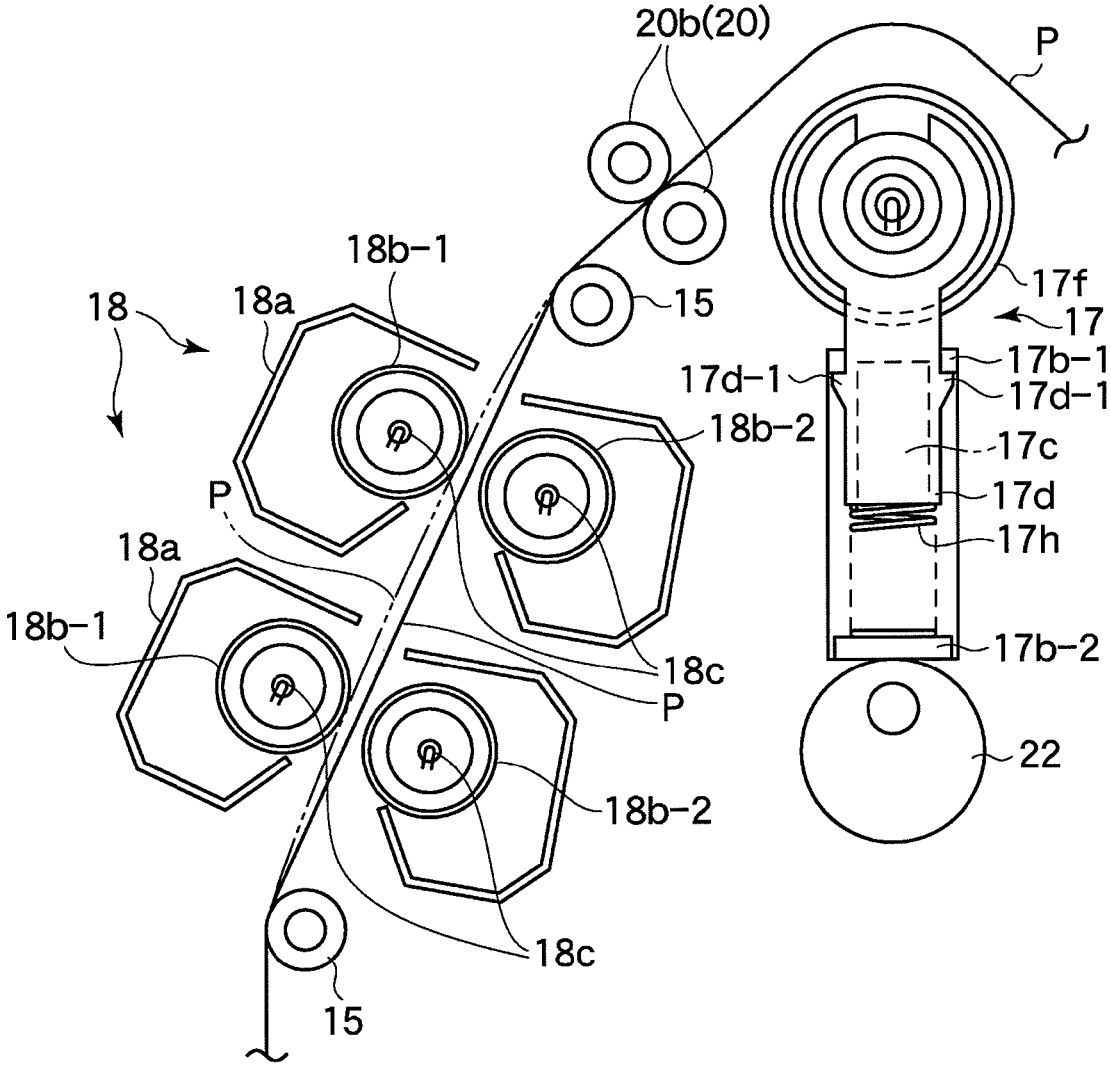
FIG. 5 is a view for explaining positions of the pre-heating member and a fixing device when an image forming operation is stopped in the image forming apparatus shown in FIG. 1.

As the eccentric cam 22 rotates from the above first position, the pre-heating member 17 will descend owing to its own weight according to a change in the contact position of the outer surface of the eccentric cam 22. Further, as shown in FIG. 5, the eccentric cam 22 moves to a second position to lower the pre-heating member 17 provided so as to freely ascend/descend with small power using the weight of the pre-heating member 17 itself thereby to depart from the continuous sheet P and stops there. Incidentally, the second position may be the position (the lowest position) where the tip of the eccentric cam 22 is lowest but may be any position where the pre-heating member 17 departs from the continuous sheet P.

Now, the pre-heating member 17 may not descend owing to its own weight as in this exemplary embodiment, but may be moved by external force applied by the moving means thereby to depart from the continuous sheet P. Therefore, the pre-heating member 17 may depart from the continuous sheet P at the descended position as shown, but may depart at the position other than the descended position.

When the pre-heating member 17 descends, it is released from the stress when it comes in contact with the continuous sheet P thereby to expand the coil spring 17*h* so that the roller holder 17*d* ascends along the second linear slider 17*c* owing to the spring force of the coil spring 17*h*. Then, as shown, the projections 17*d*-1 formed in the roller holder 17*d* hits against the upper plate 17*b*-1 of the holder support 17*b* so that further lifting of the roller holder 17*d* is stopped.

In the pre-heating member 17 according to this exemplary embodiment, the heating roller 17*f* and the coil spring 17*h* are accommodated in the holder support 17*b* so that they ascend/descent integrally to each other. The weight of the pre-heating member 17, therefore, increases so that the descending speed when the image forming operation stops is increased. Thus, when the image forming operation stops, the heating roller 17*f* and the coil spring 17*h* descend at a further high speed in the direction of gravity to depart from the continuous sheet P. Accordingly, the continuous sheet P is surely prevented from being thermally damaged by the pre-heating member 17 while the image is not formed.

Incidentally, the first position may be the position (apex) where the tip of the eccentric cam 22 is highest, but in this exemplary embodiment, it is located at the position slightly displaced therefrom. Thus, when the driving force from the eccentric cam driving motor 25 for driving the eccentric cam 22 is interrupted owing to e.g. stopping of power supply to the eccentric cam driving motor 25, the pre-heating member 17 descends due to its own weight to depart from the continuous sheet P, thereby depressing the eccentric cam 22 to the lowest position (second position). Accordingly, when the eccentric cam 22 has become not driven, the pre-heating member 17 is surely departed from the continuous sheet P to prevent thermal damage of the continuous sheet P.

It should be noted that the moving means is not limited to the combination of a cam such as the eccentric cam 22 and a motor such as the eccentric cam driving motor 25 as in this exemplary embodiment, but may be various members which move to the first position and second position to elevate or lower the pre-heating member 17.

The fixing device 18 for fixing the toner image on the continuous sheet P previously heated by the pre-heating member 17 having the structure described above is arranged as two units in the transporting direction as shown in FIG. 1. These fixing devices 18 each is provided with a pair of rollers 18*b*-1 and 18*b*-2 (an example of a rotating body) which are housed in housings 18*a*, respectively. One of these rollers 18*b*-1 and 18*b*-2 is a driving roller 18*b*-1 while the other thereof is a driven roller is a driven roller 18*b*-2 which is in pressure-contact with the driving roller 18*b*-1 to rotate to follow the driving roller 18*b*-1. These rollers 18*b*-1 and 18*b*-2 each incorporates a heater 18*c* to heat the continuous sheet P. The fixing device 18 may be arranged as a single or three or more units.

As shown in FIGS. 4 and 5, the pair of rollers 18*b*-1 and 18*b*-2 constituting the fixing device 18 move to a contact position where they comes into contact with each other (FIG. 4) and a departing position where they depart from each other (FIG. 5); they are arranged so that the transporting posture of the continuous sheet P changes between the contact position and departing position. This is because the driving roller 18*b*-1 is offset toward a direction departing from the line connecting the tension rollers 15 arranged in front of and behind the fixing device 18 in the transporting direction.

Specifically, in FIG. 5, the transporting posture of the continuous sheet P indicated in solid line is that at the departing position where the pair of rollers 18*b*-1 and 18*b*-2 depart from each other. At this time, since the driving roller 18*b*-1 is offset, the continuous sheet P is on the line connecting the tension rollers 15 arranged in front of and behind the fixing device 18 in the transporting direction and departs from the pair of rollers 18*b*-1 and 18*b*-2.

In FIG. 5, the transporting posture of the continuous sheet P indicated in two-dot chain line is that at the contact position where the pair of rollers 18*b*-1 and 18*b*-2 come in contact with each other. At this time, the continuous sheet P is changed in its transporting posture to follow the driven roller 18*b*-2 brought into contact with the driving roller 18*b*-1 so that it is sandwiched between the driving rollers 18*b*-1 and 18*b*-2 (also see FIG. 4).

Incidentally, while the image is formed, the driving roller 18*b*-1 and driven roller 18*b*-2 of the fixing device 18 come in contact with each other so that they are located at the contact position of sandwiching the continuous sheet P (FIG. 4). While the image is not formed, they depart from each other so that they are located at the departing position not in contact with the continuous sheet P (FIG. 5).

Thus, while the image is not formed, since the driven roller 18*b*-2 departs from the driving roller 18*b*-1, these rollers 18*b*-1 and 18*b*-2 surely depart from the continuous sheet P.

Now, as shown, the driving roller 18*b*-1 and driven roller 18*b*-2 are not in direct contact with each other but in indirect-contact with each other through the continuous sheet P. In this invention, it should be noted that the "contact" includes such indirect contact.

Additionally, in this exemplary embodiment, the driven roller 18*b*-2 departs from the driving roller 18*b*-1, but inversely the driving roller 18b-1 may depart from the driven roller 18*b*-2.

Figure 6:
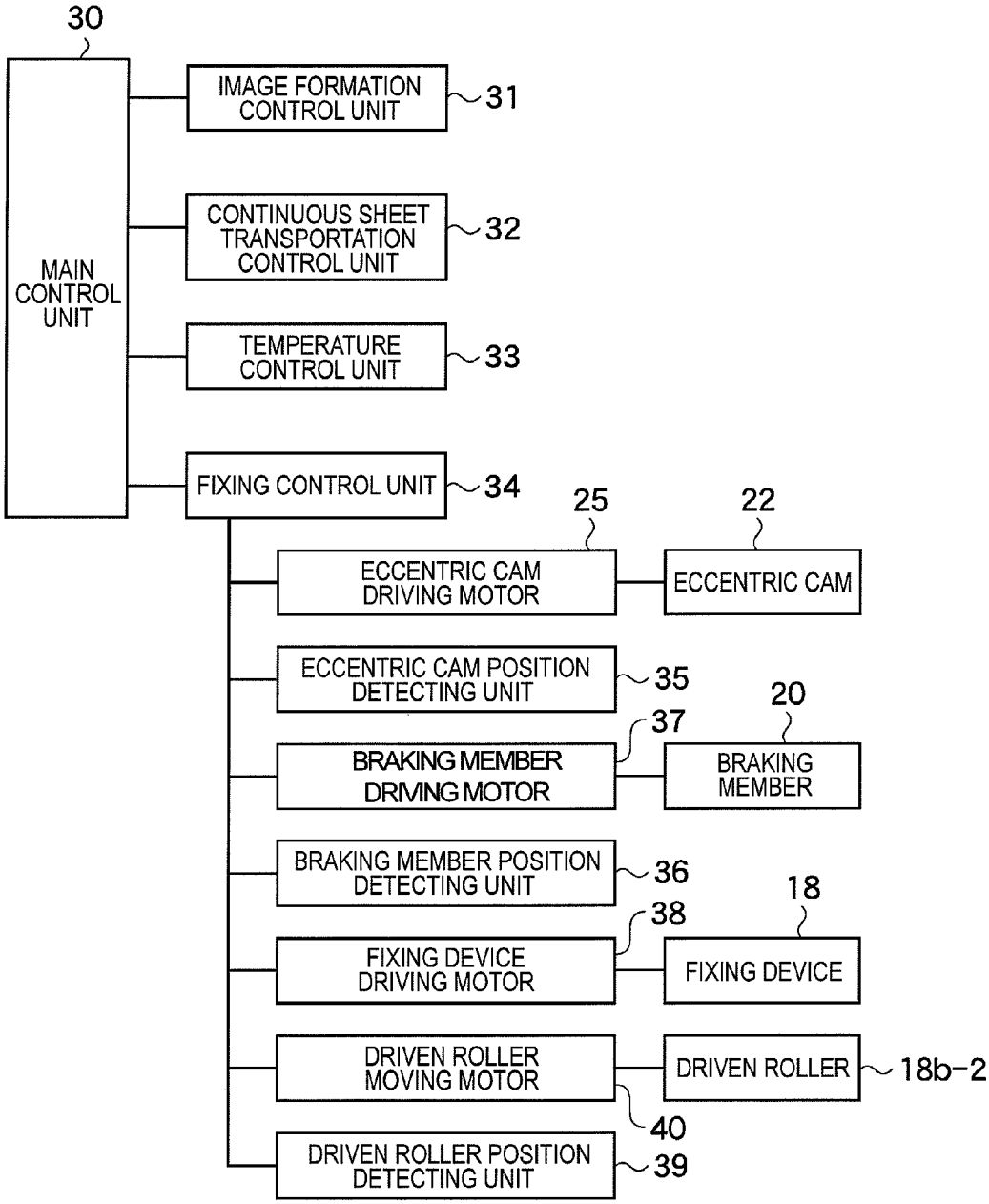
FIG. 6 is a block diagram of a control system in the image forming apparatus shown in FIG. 1.

The image forming apparatus 10 having the structure as described above, as shown in FIG. 6, includes, as a control system, a main control unit 30 (an example of a control means); an image formation control unit 31 (an example of the control means); a continuous sheet transportation control unit 32 (an example of the control means); a temperature control unit 33 (an example of the control means); and a fixing control unit 34 (an example of the control means).

The main control unit 30 acquires image information and control information transmitted from a computer (not shown) and on the basis of the acquired items of information, controls the image formation control unit 31, continuous sheet transportation control unit 32, temperature control unit 33 and fixing control unit 34.

The image formation control unit 31 controls the image formation in the image forming unit 16 on the basis of the image data acquired from the main control unit 30.

The continuous sheet transportation control unit 32 controls the rotating speed of the continuous sheet transporting roller 14 and the rotating speed of the take-up mandrel 12 on the basis of the transporting speed of the continuous sheet P and the loop quantity of the continuous sheet P. Further, the continuous sheet transportation control unit 32 controls the rotation of the continuous sheet transporting roller 14 and take-up mandrel 12 so that the transportation of the continuous sheet P is done while the image is formed and the transportation of the continuous sheet P is stopped while the image is not formed.

The temperature control unit 33 controls the temperature of the heater 17*e* incorporated in the heating roller 17*f* of the pre-heating member 17 and the temperature of the heater 18*c* incorporated in each the rollers 18*b*-1 and 18*b*-2 of the fixing device 18.

The fixing control unit 34 controls the operation of each of the members involved in the fixing operation.

Concretely, the fixing control unit 34 controls the rotation of the eccentric cam driving motor 25 while detecting the position of the eccentric cam 22 using the eccentric cam detecting unit 35 so that while the image is formed on the continuous sheet P, the eccentric cam 22 rests at the first position (where the pre-heating member 17 is elevated to come in contact with the continuous sheet P: FIG. 4) and while the image is not formed on the continuous sheet P, the eccentric cam 22 rests at the second position (where the pre-heating member 17 is lowered owing to its own weight to depart from the continuous sheet P: FIG. 5).

Further, the fixing control unit 34 controls the rotation of a braking member driving motor 37 while detecting the position of a pair of braking members 20 (an upstream side braking member 20*a* and a downstream side braking member 20*b*) using a braking member position detecting unit 36 so that while the image is formed on the continuous sheet P, the pair of braking members 20 depart from the continuous sheet P (FIG. 4), and while the image is not formed on the continuous sheet P, the pair of braking members 20 sandwich the continuous sheet P from both sides to brake its transportation (FIG. 5).

Incidentally, while the image is not formed, i.e. the continuous sheet P is not transported, the upstream side braking member 20*a* and downstream side braking member 20*b* provided on both sides in the transporting direction of the pre-heating member 17 sandwich the continuous sheet P to brake the continuous sheet P located in front of and behind the pre-heating member 17, thereby suppressing a change in the posture of the continuous sheet P braked by the braking members 20.

Thus, if the pre-heating member 17 is lowered after the continuous sheet P has been braked by the braking members 20, the continuous sheet P is nearly kept in its form due to its nerve and will not be greatly warped downward according to the descend of the pre-heating member 17. Accordingly, the pre-heating member 17 will be surely departed from the continuous sheet P so that the thermal damage of the continuous sheet P caused by the pre-heating member 17 while the image is not formed can be prevented.

Additionally, if the length of the continuous sheet P sandwiched by the upstream side braking member 20*a* and the downstream side braking member 20*b* is shorter, the posture of the continuous sheet P when it is braked by the braking member 20 will be changed in a smaller quantity. So, the upstream side braking member 20*a* and the downstream side braking member 20*b* may be arranged nearer to the pre-heating member 17 within a range not interfering with the pre-heating member 17.

Further, the fixing control unit 34 controls the rotation of the fixing driving motor 38 so that while the image is formed on the continuous sheet P, the fixing device 18 (more correctly, the driving roller 18*b*-1 attached to the fixing device 18) rotates and while the image is not formed on the continuous sheet P, its rotation stops.

Further, the fixing control unit 34 controls the rotation of a driven roller moving motor 40 while detecting the position of the driven roller 18*b*-1 using a driven roller position detecting unit 39 so that while the image is formed on the continuous sheet P, the driven roller 18*b*-1 rests at the contact position where the driven roller 18*b*-2 of the fixing device 18 comes in contact with the driven roller 18*b*-1 and while the image is not formed on the continuous sheet P, the driven roller 18*b*-1 rests at the departing position where the driven roller 18*b*-2 of the fixing device 18 departs from the driving roller 18*b*-1.

It should be noted that a part or entirety of the motors 25, 37, 38 and 40 may be shared among one another. Further, the eccentric cam 22, braking member 20, fixing device 18 and driven roller 18*b*-2 may be driven or moved by the means other than the motor.

Next, an explanation will be given of the operation of the image forming apparatus 10 having the configuration described above.

In starting the image forming operation, through the fixing control unit 34, by the eccentric cam driving motor 25, the eccentric cam 22 is moved to the first position so that the pre-heating member 17 comes in contact with the continuous sheet P under a tension by the spring force of the coil spring 17*h*. Next, the braking member 20 is moved to the position departing from the continuous sheet P by the braking member driving motor 37 thereby to release the braking of the continuous sheet P. Further, by the driven roller moving motor 40, the driven roller 18*b*-2 is moved to the position where it comes in contact with the driving roller 18*b*-1, thereby making a nip. Further, the temperature of the heater 17*e* of the pre-heating member 17 and the temperature of the heater 18*c* of the fixing device 18 are controlled to predetermined temperatures, respectively by the temperature control unit 33, and the fan 19*a* of the cooler 19 is rotated. The continuous sheet transporting roller 14 and take-up mandrel 12 are rotation-driven by the continuous sheet transportation control unit 32 and also the fixing device 18 is driven by the fixing device driving motor 38 through the fixing control unit 34. Thus, the continuous sheet P is transported. In such a condition, in the image forming unit 16 controlled by the image formation control unit 31, using the toners, the image is formed on the continuous sheet P.

The continuous sheet P with the toner image formed by the image forming unit 16 is heated by the pre-heating member 17 and thereafter the toner image is fixed by the fixing device 18. Further, the continuous sheet P is cooled by the cooler 19 and recovered by the take-up mandrel 12.

In this way, the continuous sheet P is transported after the pre-heating member 17 comes in contact with the continuous sheet P and next the braking member 20 departs from the continuous sheet P. So, with changes in the posture of the continuous sheet P being suppressed by the braking member 20, the pre-heating member 17 will come in contact with the continuous sheet P. Thus, generation of wrinkles or waves when the pre-heating member 17 comes in contact with the continuous sheet P is prevented, thereby preventing deterioration of the image quality when the image is formed.

Figure 7:
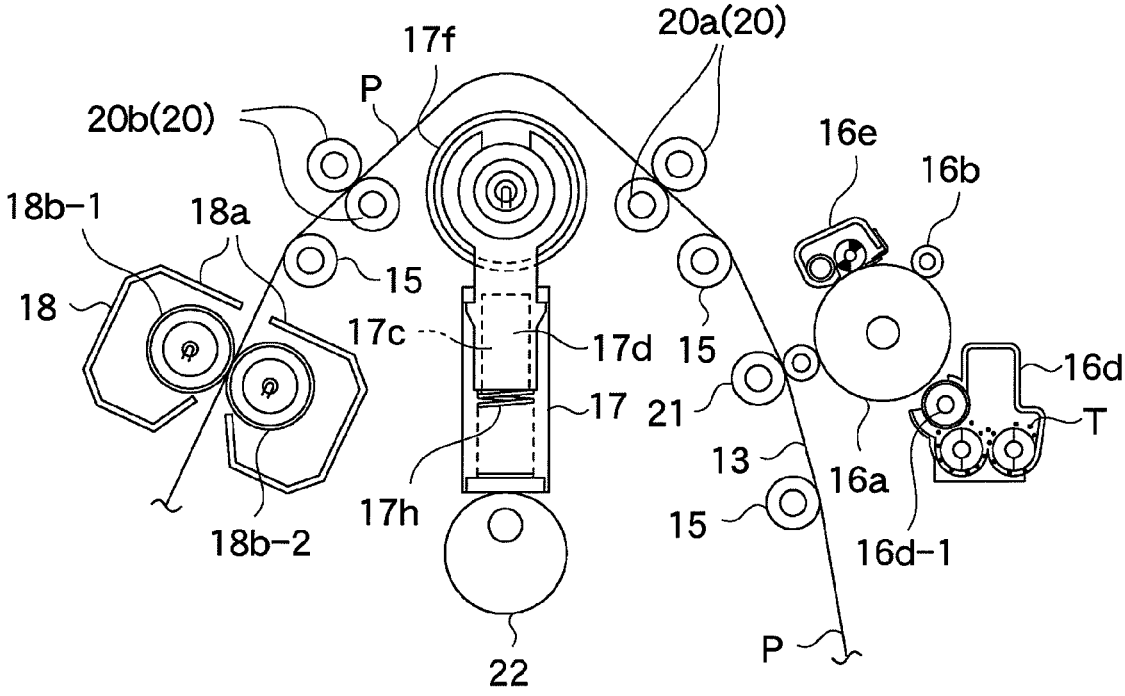
FIG. 7 is a view showing the state where the pre-heating member has departed from the continuous sheet in the image forming apparatus shown in FIG. 1.

While the image formation operation is stopped, the operation of the image forming unit 16 stops; the rotation of the continuous sheet transporting roller 14 and take-up mandrel 12 stops and the operation of the fixing device 18 also stops so that the transportation of the continuous sheet P is stopped. In addition, power supply to the heater 17*e* of the pre-heating member 17 and the heater 18*c* of the fixing device 18 is stopped. The rotation of the fan 19*a* of the cooler 19 is also stopped. Next, the braking member 20 moves to the position of sandwiching the continuous sheet P to brake its transportation. Thereafter, the eccentric cam 22 is moved to the second position by the eccentric cam driving motor 25 through the fixing control unit 34 so that the pre-heating member 17 is departed from the continuous sheet P. The driven roller 18*b*-2 is moved by the driven roller moving motor 40 to the position departing from the driving roller 18*b*-1 so that the rollers 18*b*-1 and 18*b*-2 depart from the continuous sheet P. The state when the eccentric cam 22 has moved to the second position is shown in FIG. 7.

As described above, after the transportation of the continuous sheet P is braked by the braking member 20, the pre-heating member 17 is departed from the continuous sheet P so that changes in the posture of the continuous sheet P is suppressed. Thus, even if the pre-heating member 17 departs from the continuous sheet P, the continuous sheet P will not move freely so that the continuous sheet P will not be polluted owing to its contact with the members arranged on the transporting path 13.

In order to execute the image formation again, the operation of executing the image forming operation described will be repeated.

Now, when the image formation operation stops so that the eccentric cam 22 moves to the second position, the pre-heating member 17 swiftly lowers in the direction of gravity owing to its own weight according to the change in the contact position of the outer peripheral face of the eccentric cam 22 so that it departs from the continuous sheet P. Thus, while the image is not formed, it does not occur that the pre-heating member 17 is kept in contact with the continuous sheet P whose transportation is stopped and so heat from the pre-heating member 17 is consecutively applied to the continuous sheet P. As a result, it is possible to prevent the continuous sheet P from suffering from thermal damage such as local waving or discoloration.

Further, departure of the pre-heating member 17 from the continuous sheet P is done by the lowering operation using the weight of the pre-heating member 17 itself so that the pre-heating member 17 is departed from the continuous sheet P as the eccentric cam 22 is moved to the second position.

Further, since the pre-heating member 17 departs from the continuous sheet P without movement of the continuous sheet P, unlike the case where the continuous sheet P moves, it does not occur that in the shift to the image forming operation, the continuous sheet P does not return to the original position but meanders or waves, thereby generating "registration-displacement" or "image-missing".

Further, the image forming operation stops so that the driven roller 18*b*-2 of the fixing device 18 moves to the position departing from the driving roller 18*b*-1. The continuous sheet P thereby departs from the rollers 18*b*-1 and 18*b*-2. Thus, while the image is not formed, it does not occur that the fixing device 18 is kept in contact with the continuous sheet P whose transportation is stopped and so heat from the rollers 18*b*-1 and 18*b*-2 is consecutively applied to the continuous sheet P. As a result, it is possible to prevent the continuous sheet P from suffering from thermal damage such as local waving or discoloration.

Such departure of the fixing device 18 from the continuous sheet P is realized in such a manner that the driven roller 18*b*-2 only moves to the position departing from the driving roller 18*b*-1. For this reason, the departing mechanism of the fixing device 18 can be realized in a simple structure and at low cost.

The concrete explanation has been hitherto given of the invention accomplished by the inventors referring to the exemplary embodiment. However, the exemplary embodiment disclosed in this specification is exemplary in all the points, and should not be limited to the techniques disclosed. Namely, the technical scope of this invention should not be limitedly construed on the basis of the explanation of the exemplary embodiment but should be construed according to the description of Claims. It includes the techniques equivalent to the techniques described in the Claims and all the changes not departing from the sprit of the Claims.

For example, in the pre-heating member 17 in this exemplary embodiment, the cylindrical heating roller 17*f* incorporating the heater 17*e* is brought into contact with the continuous sheet P. However, as shown in FIGS. 8 and 9, instead of such a heating roller, a plate-like heating plate 17*j* with a planar heater 17*i* affixed thereto may be adopted.

On both sides in the transporting direction of the heating plate 17*j*, the pre-heating member 17 as shown is provided with rollers 17*m* so that the continuous sheet P is smoothly guided to the heating plate 17*j* and smoothly sent out therefrom. To the bottom the heating plate 17*j*, a pair of stays 17*k* extending downwardly are attached. These stays 17*k* are fit in guide holes 17*n*-1 upward opened in a stand 17*n* arranged below the heating plate 17*j* so that the heating plate 17*j* is vertically movable. Between the heating plate 17*j* and the stand 17*n*, a coil spring 17*q* is fit.

Figure 8:
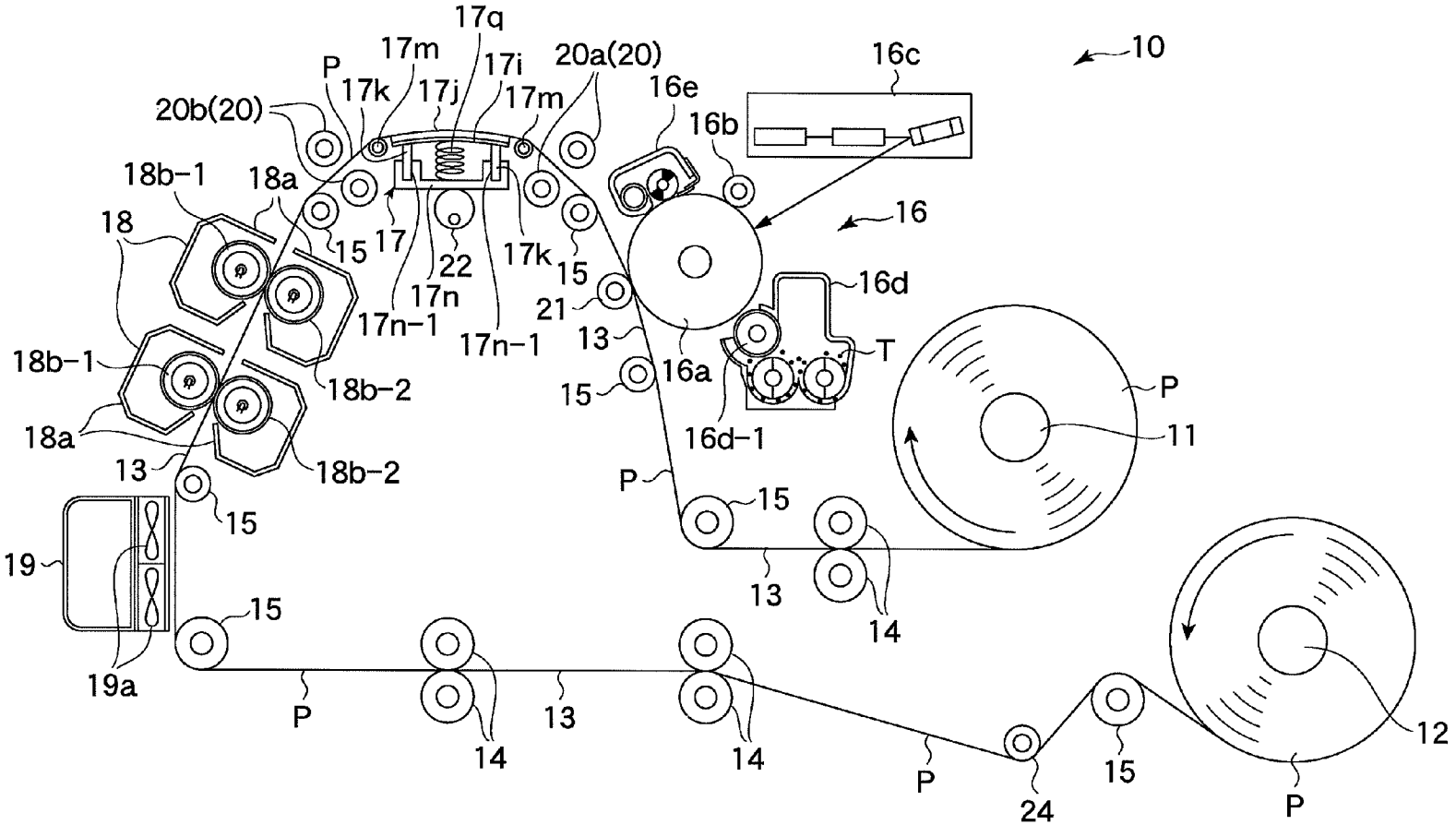
FIG. 8 is a conceptual view showing an image forming apparatus according to an exemplary embodiment of this invention in which a pre-heating member as a modification is employed.

In such a construction, as shown in FIG. 8, when the eccentric cam 22 moves to the first position, the stand 17*n* is lifted and thereby the stays 17*k* of the heating plate 17*j* ascend while sinking in the guide holes 17*n*-1 through the coil spring 17*q* so that the heating plate 17*j* comes in contact with the continuous sheet P. At this time, according to the stress when the heating plate 17*j* comes in contact with the continuous sheet P, the coil spring 17*q* is compressed; the coil spring 17*q* also contracts/expands so that the heating plate 17*j* follows the float or sink of the continuous sheet P during transportation, thereby always applying required tension to the continuous sheet P. Thus, slack of the continuous sheet P during transportation does not occur owing to the tension applied by the coil spring 17*q* so that the pre-heating member 17 is surely brought into contact with the continuous sheet P to heat it.

Figure 9:
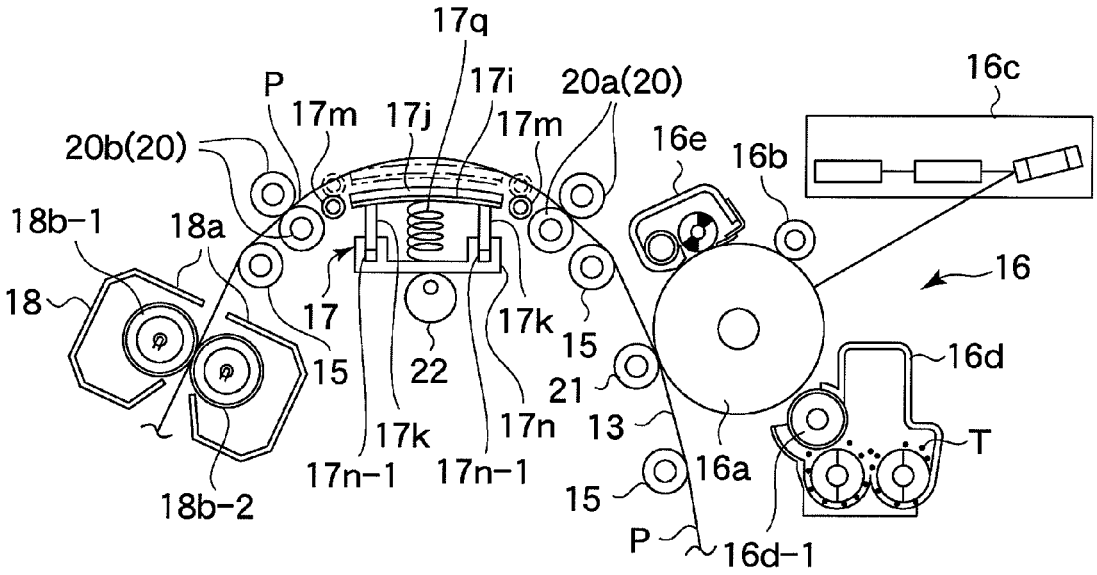
FIG. 9 is a view showing the state where the pre-heating member has departed from the continuous sheet in the image forming apparatus shown in FIG. 8.

Further, as shown in FIG. 9, when the eccentric cam 22 moves to the second position, the pre-heating member 17 lowers owing to its own weight to depart from the continuous sheet P. At this time, the coil spring 17*q* is released from the stress when the heating plate 17*j* comes in contact with the continuous sheet P and so expands. Further, the distance between the heating plate 17*j* and the stand 17*n* is increased so that the stays 17*k* go out from the guide holes 17*n*-1 more greatly than the case being in contact with the continuous sheet P.

In the explanation hitherto made, it is assumed that this invention is applied to the image forming apparatus which forms the image using the toner of a single color. However, this invention may be applied to the image forming apparatus which forms the image in color in such a manner that plural of image forming units each equipped with a photoconductor drum are arranged in tandem along the transporting path, or plural of image forming units are arranged around a single photoconductor drum commonly used. Further, it is needless to say that the system for image formation is not limited to an electrophotographic system but may be the other system such as an ink-jet system.

What is claimed is:

1. An image forming apparatus comprising:

a transporting path along which a continuous recording medium formed an image is transported;

a heating unit on the transporting path that is movably provided in a direction coming in contact with and departing from the continuous recording medium and that heats the continuous recording medium;

a braking unit that has a first braking member and a second braking member and that brakes transportation of the continuous recording medium by sandwiching in the continuous recording medium between the first braking member and the second braking member, wherein the first braking member is provided on upstream side on the transporting path of the heating unit and the second braking member is provided on downstream side on the transporting path of the heating unit; and a control unit that controls that the heating unit is brought into contact with the continuous recording medium and the braking of the continuous recording medium is released by the braking unit, and that the heating unit is moved in the direction departing from the continuous recording medium and the continuous recording medium is braked by the braking unit.

2. The image forming apparatus according to claim 1, wherein the control unit controls that the heating unit moves in a direction departing from the continuous recording medium after the continuous recording medium is braked by the braking unit.

3. The image forming apparatus according to claim 1, wherein the control unit controls that the braking of the continuous recording medium is released by the braking unit after the heating unit is brought into contact with the continuous recording medium, and controls that the continuous recording medium is transported after the braking of the continuous recording medium is released by the braking unit.

4. The image forming apparatus according to claim 1, wherein the braking unit brakes the transportation of the continuous recording medium to release the heating unit from the continuous recording medium.

5. An image forming apparatus comprising:

a transporting path along which a continuous recording medium formed an image is transported;

an image forming unit that is provided on the transporting path to form an image on the continuous recording medium;

a heating unit that is arranged on a downstream side of the transporting path of the image forming unit, that is movably provided in a direction coming in contact with and departing from the continuous recording medium formed the image and that heats the continuous recording medium;

a braking unit that has a first braking member and a second braking member and that brakes transportation of the continuous recording medium by sandwiching in the continuous recording medium between the first braking member and the second braking member, the first braking member is provided on upstream side on the transporting path of the heating unit and the second braking member is provided on downstream side on the transporting path of the heating unit;

a fixing unit that is equipped with a pair of rollers, is provided on the downstream side of the transporting path of the heating unit, and is arranged to sandwich the continuous recording sheet at a contact position where the pair of rollers come in contact with each other and depart from the continuous recording medium at a departing position where the pair of rollers departs from each other, the fixing unit fixing the image on the continuous recording medium with the image formed; and a control unit that controls that (i) when the image is formed on the continuous recording medium, the heating unit is moved in a direction coming in contact with the continuous recording medium, the fixing unit is located at the contact position and the continuous recording medium is not braked by the braking unit; and (ii) when the image is not formed on the continuous recording medium, the heating unit is moved in a direction departing from the continuous recording medium, the fixing unit is located at the departing position and the continuous recording medium is braked by the braking unit.

* * * * *